United States Patent [19]

Gewirtz

[11] 4,288,072

[45] Sep. 8, 1981

[54] ILLUSION CREATING DEVICE

[76] Inventor: William Gewirtz, 2500 Johnson Ave., Bronx, N.Y. 10463

[21] Appl. No.: 77,724

[22] Filed: Sep. 21, 1979

[51] Int. Cl.[3] ..... A63J 21/00

[52] U.S. Cl. ..... 272/8 N

[58] Field of Search ..... 272/8 R, 8 D, 8 N, 1 R

[56] References Cited

U.S. PATENT DOCUMENTS

| | | | |
|---|---|---|---|
| 513,450 | 1/1894 | Armstrong | 272/8 R |
| 565,254 | 8/1896 | Baer | 272/8 N |
| 726,615 | 4/1903 | Armstrong | 272/8 N |
| 787,535 | 4/1905 | McGrath | 272/8 N |
| 2,199,818 | 5/1940 | Franke | 272/8 N |

FOREIGN PATENT DOCUMENTS

| | | | |
|---|---|---|---|
| 1287142 | 1/1962 | France | 272/8 R |

*Primary Examiner*—Richard C. Pinkham
*Assistant Examiner*—Arnold W. Kramer
*Attorney, Agent, or Firm*—Stephen E. Feldman; Marvin Feldman

[57] ABSTRACT

An illusion creating device comprises a support structure having a support edge encircling an aperture and a flat element. An elastic membrane is supported on the support edge and is stretched over the flat element to a degree wherein a supporting segment of the membrane underlies a portion of the element and supports it. The flat element is viewable through the membrane so as to appear to be disposed on top of the membrane. Pressing the stretched membrane over the flat element causes the element to be released from the membrane, thereby creating the illusion that the flat element passed through the membrane.

9 Claims, 4 Drawing Figures

FIG. 1
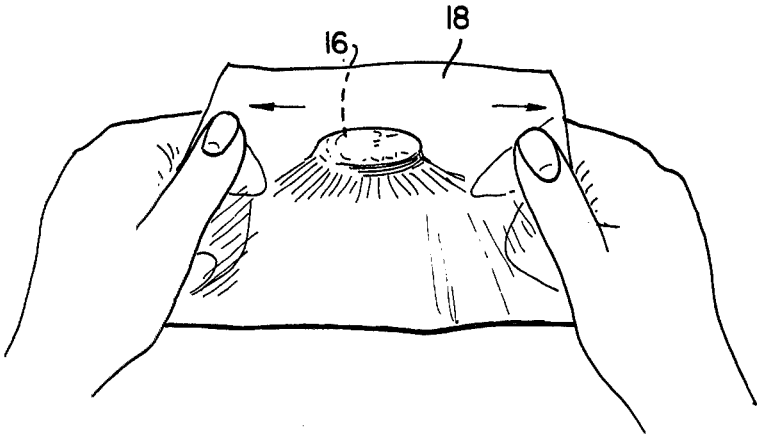
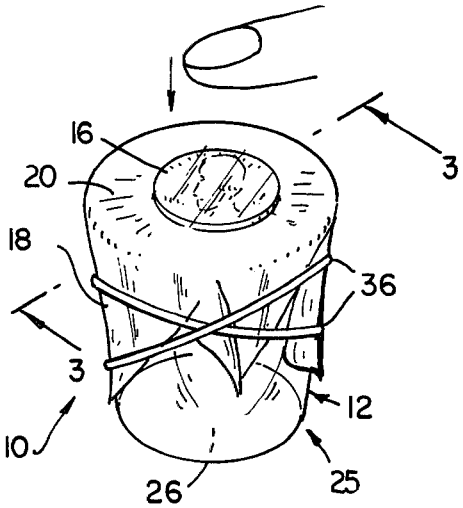
FIG. 2
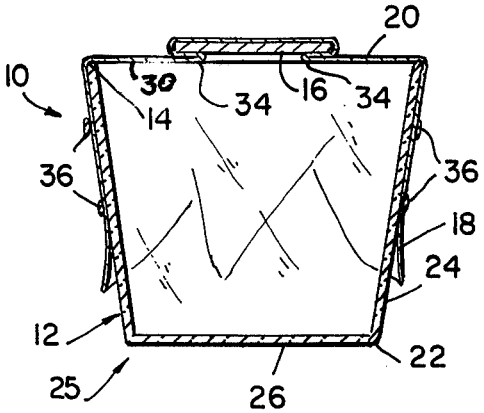
FIG. 3
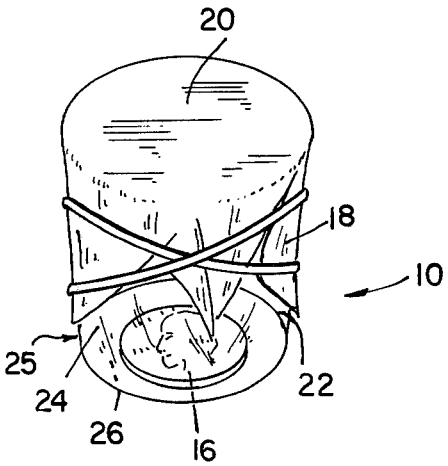
FIG. 4

ILLUSION CREATING DEVICE

BACKGROUND OF THE INVENTION

While the invention is subject to a wide range of applications, it is especially suited for use as a magic trick and will be particularly described in that connection. In the area of entertainment, there is always a need for new devices which the public might find intriguing. Specifically, a magician is always concerned with finding new tricks to add to his repertoire.

It is an object of the present invention to provide an illusion-creating device which is very simple to use.

It is a further object of the present invention to provide an illusion creating device which is inexpensive to manufacture.

SUMMARY OF THE INVENTION

Accordingly, there is provided an illusion creating device comprising a support structure having a support edge and a flat element. An elastic membrane is supported on the support edge and is stretched over the flat element to a degree wherein the element is supported by the membrane. The flat element is viewable through the membrane so as to appear to be disposed on top of the membrane. Pressing the stretched membrane over the flat element causes the element to be released from the membrane, thereby creating the illusion that the flat element passed through the membrane.

For a better understanding of the present invention, together with other and further objects, thereof, reference is had to the following description, taken in connection with the accompying drawings, while its scope will be pointed out in the appended claims.

BRIEF DESCRIPTION OF THE DRAWINGS

FIG. 1 is a plan view of an elastic membrane being stretched over a circular coin;

FIG. 2 is a plan view of an elastic membrane supporting a circular coin being affixed to a support structure;

FIG. 3 is a cross-sectional view through 3—3 of FIG. 2; and

FIG. 4 is a plan view of a circular coin which has been released from an elastic membrane and has fallen to the bottom of the support structure.

DESCRIPTION OF THE PREFERRED EMBODIMENT

An illusion creating device 10 comprises a support structure 12 having a support edge 14. A flat element 16 is included with the device 10. An elastic membrane 18 is supported on the support edge 14 and stretched over the flat element 16 to a degree where the element is supported by the membrane. At this point, the element is viewable through the membrane so as to appear to be disposed on the top 20 of the membrane. By pressing the stretched membrane over the flat element, the element is released from the membrane and thereby creates the illusion that the element has passed through the membrane.

The support structure 12 includes a support edge 14, a base edge 22 and a side wall 24 which extends between the support edge and the base edge. The support structure 12 as shown, is a container having an opening defined by the support edge and a closed bottom defined by a base element 26 which is adjoined to the base edge 22. Although the container 25 is illustrated as a cup with the base edge and the support edge being substantially circular while the side wall flares outwardly to form a frustro-conical shaped container, it is within the scope of the present invention to form the container 25 as a cylinder, or a rectangle or in any other desired configuration. Further, if desired, the base element 26 may be eliminated and the side wall could be formed of sections of material rather than one continuous surface as shown. The elastic membrane 18 includes a top surface 20 and a bottom surface 30. The membrane is preferrably formed of a pure latex material which is highly elastic and very thin. It is, however, within the scope of the invention to form a membrane of any desired highly elastomeric, polymer. The membrane is preferrably not transparent when it is in an unstretched condition, and substantially transparent in a stretched condition.

A flat element 16 which is preferably rounded, such as for example a circular coin, which has a curved linear edge is used as the device which creates the illusion, as will be further explained. Although it is within the scope of the present invention that the flat element is of any desired shape, it is preferable that it be circular in that it will not have a tendency to cut the membrane when it is affixed to the membrane.

In order to more fully understand the present invention, the following description of its operation is provided.

As shown in FIG. 1, the membrane is stretched over the flat element 16 to a degree where the element is supported by the membrane. The membrane actually maintains its stretched condition underneath the flat element after it is released and creates a support surface indicated at 34, which holds the flat element in place. In order to easily place the element onto the membrane, the element is placed against the bottom surface 30 of the membrane when it is in a stretched condition. Then the membrane is released and the segment thereof constituting the support surface 34 is formed under the flat element. The stretched portion of the membrane over the flat element is transparent while the remainder of the membrane is not transparent. Thus, the details of the flat element or circular coin can be readily seen and in fact, the coin appears to be disposed on top of the membrane and not covered by any of the membrane.

Then the membrane with the coin supported therein is placed on the support edge 14 of the container and the portion of the membrane which extends beyond the support edge is folded over onto the container and attached thereto by any suitable means, such as for example, a rubber band 36. At this point, the illusion creating device 10 consists of a cup having an elastic membrane 18 affixed to it and a coin appearing to be disposed on top of the membrane.

The person who is presenting the trick presses the stretched membrane above the coin and thereby causes the coin to be released from the membrane wherein it falls to the base element 26 of the container. This creates the illusion that the coin has passed through the membrane.

It is thus recognized by one skilled in the art that an illusion creating device has been provided which is easy to operate and relatively inexpensive to produce.

While there has been described, what is at present considered to be the preferred embodiment of the invention, it will be obvious to those skilled in the art that various changes and modifications may be made therein, without departing from the invention and it is, therefore, aimed in the appended claims to cover all such changes and modifications as fall within the true spirit and scope of the invention.

What is claimed is:

1. An illusion creating device comprising:

a. a support structure having a support edge encircling an aperture;

b. a rigid flat element smaller in diameter than the diameter of said aperture; and c. an elastic membrane means being supported on said support edge and being stretched over said flat element to a degree wherein a supporting segment of said membrane underlies at least a portion of said element and supports the same, said element being viewable through said membrane so as to appear to be disposed on top of said membrane and said aperture whereby pressing said stretched membrane means over said flat element causes said element to be released from said membrane creating the illusion that the flat element passed through said membrane.

2. The illusion creating device of claim 1 further characterized in that said elastic membrane means is substantially transparent in its stretched condition and not transparent in its unstretched condition.

3. The illusion creating device of claim 2 further characterized in that said elastic membrane means is formed from a polymer.

4. The illusion creating device of claim 3 further characterized in that said elastic membrane means is formed from pure latex.

5. The illusion creating device of claim 1 further characterized in that said support structure includes a base edge and a side wall extending between said support edge and said base edge.

6. The illusion creating device of claim 5 further characterized in that said base edge and said support edge are substantially circular.

7. The illusion creating device of claim 6 further characterized in that said support structure is a container with a base element adjoined to said base edge.

8. The illusion creating device of claim 1 further characterized in that said flat element has a curvulinear edge.

9. The illusion creating device of claim 8 further characterized in that said flat element is a circular coin.

* * * * *